United States Patent [19]

Lin

[11] Patent Number: 4,721,948

[45] Date of Patent: Jan. 26, 1988

[54] WALLET WITH MISSING-CARD REMINDER

[76] Inventor: Wen-Tsung Lin, P.O. Box 74-9, Taipei, Taiwan

[21] Appl. No.: 30,088

[22] Filed: Mar. 26, 1987

[51] Int. Cl.[4] ..... G08B 7/00; G08B 21/00

[52] U.S. Cl. ..... 340/568

[58] Field of Search ..... 340/568

[56] References Cited

U.S. PATENT DOCUMENTS

| | | | |
|---|---|---|---|
| 3,959,789 | 5/1976 | McGahee | 340/568 |
| 4,480,250 | 10/1984 | McNooly | 340/568 |
| 4,652,865 | 3/1987 | Maharshak | 340/568 |

FOREIGN PATENT DOCUMENTS

| | | | |
|---|---|---|---|
| 4656885 | 2/1986 | Australia | 340/568 |

*Primary Examiner*—James L. Rowland
*Assistant Examiner*—Tat K. Wong

[57] ABSTRACT

A wallet includes a pair of leaves foldable upon each other having two longitudinal metallic strips adhered on a magnet strip formed on a right leaf of the two leaves, a plurality of card bags adapted for inserting credit cards, lift cards, etc. therein each bag having a lower opening, a metallic foil chip backed with a ferrous chip corresponding to the lower opening to be operatively contacted with two matallic strips formed on the right leaf adapted to complete an alarm circuit, and an alarm circuit having a light-emitting diode (LED), a sensitive photoresistor and a inert photoresistor subject to light exposure from the LED when closing the two leaves, whereby if any card is not inserted in the bag, the foil chip will be magnetically driven to contact the two metallic strips to close the alarm circuit and light LED to thereby increase a positive voltage through the inert photoresistor to start the sounding IC to remind the wallet owner for his or her possible missing of a card.

1 Claim, 5 Drawing Figures

WALLET WITH MISSING-CARD REMINDER

BACKGROUND OF THE INVENTION

McNeely disclosed a credit card carrier with alarm in his U.S. Pat. No. 4,480,250 including a pair of flaps foldable with each other, each flap provided clip switches adapted for receiving credit cards therein, so that when a credit card is missing from one of the clip switches, a circuit between a battery and an alarm is completed to sound an alarm to alert the owner. However such a credit card carrier has the following defects:

1. After being used for a long time, the clip switches may be distorted, twisted or damaged to influence the sharp contacting of electricity to even lose their alarm-sensing effect.

2. In order to prevent a false alarm just upon the opening of the pair of flaps when not removing any card from the clip, a reed (proximity) switch 26, 28 must be provided in his invention to open the alarm circuit, which however may be easily broken or damaged to lose the function of the reed switch, especially when it is mounted on a soft wallet and kept in a trouser pocket to therby be easily squeezed and broken.

3. The card is only clamped by the spring-biased clip without being further defined or limited in a card sheath or jacket so that the card may possibly be loosened from the clip to cause false alarm.

4. If double cards are commonly clamped in a clip switch and if only one of the two cards is missing, the other card is still kept in clip without causing alarm and without exerting warning effect.

The present inventor has found the defects of a conventional credit card carrier and invented the present wallet with missing-card reminder.

SUMMARY OF THE INVENTION

The object of the present invention is to provide a wallet including a pair of leaves foldable upon each other having a pair of conductive metallic strips electrically connected to an alarm circuit adhered on a soft thin-layer magnet strip fixed on the right leaf, a plurality of card bags adapted for inserting credit cards or life cards therein consecutively formed on a carrier cover fixed on the right leaf each bag being cut with a lower opening on its lower edge and having a coductiove metal chip backed with thin-layer ferrous chip formed on the lower portion of the bag facing the lower opening and operatively contacting the metallic strips on the right leaf, and an alarm circuit having a light-emitting diode (LED) formed on the right leaf, an inert photoresistor formed on the right leaf aside from the LED, and a sensitive photoresistor formed on the left leaf corresponding to the LED, whereby when folding to close the two leaves and when forgetting to reinsert any card into the card bag, the metal chip backed with the ferrous chip on the bag will be magnetically attracted to the metallic strips backed with magnet strip on the right leaf to close the alarm circuit and a positive voltage will be charged to a trigger pin of a sounding integrated circuit of the alarm through the inert photoresistor under exposure of LED to start the sounding of the alarm circuit for reminding the card owner.

DETAILED DESCRIPTION

Figure 1:
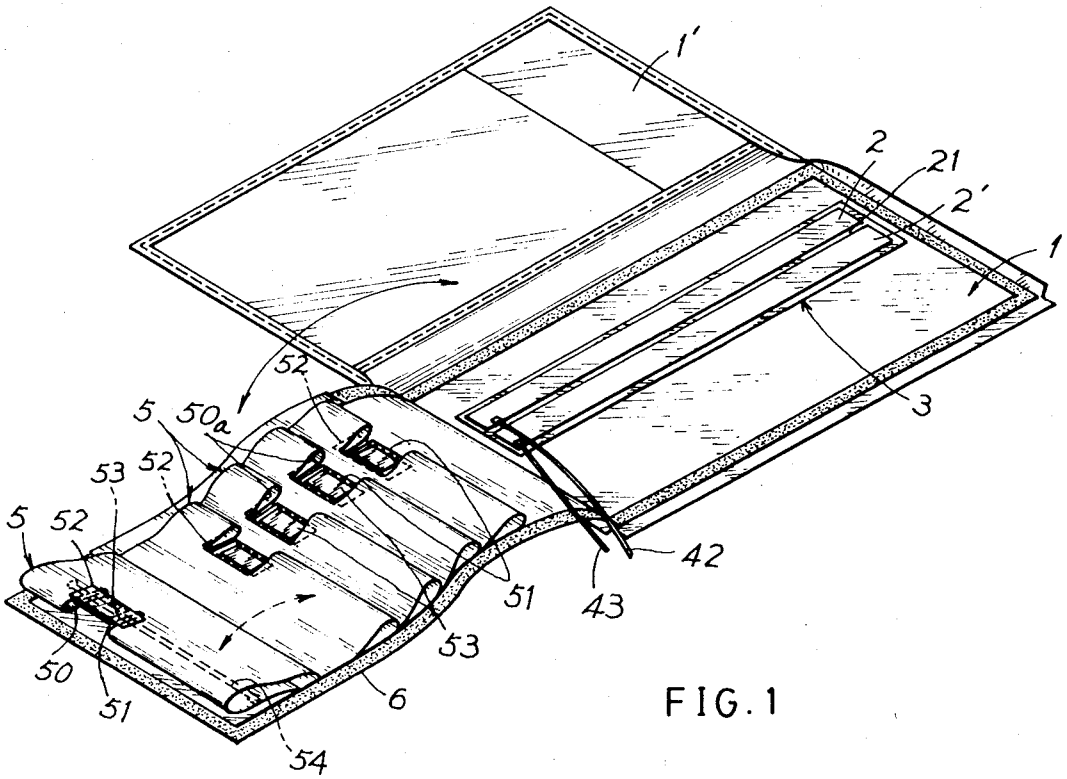
FIG. 1 is a perspective illustration when uncovering the card bags of the present invention.
Figure 2:
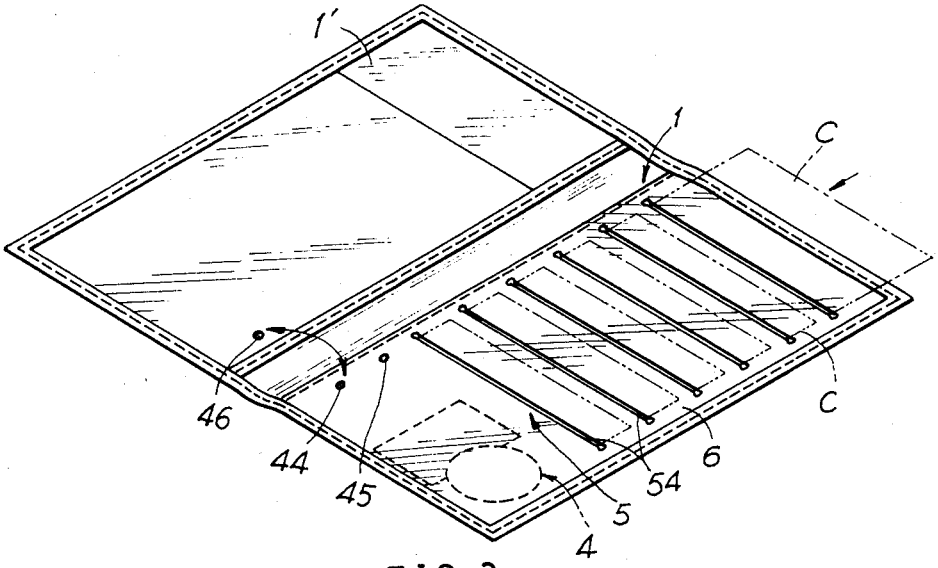
FIG. 2 is a perspective view of the present invention.

As shown in the figures, the present invention comprises: a pair of leaves 1, 1' foldable upon each other, two longitudinal conductive metallic strips 2, 2' having an aperture 21 spaced therebetween adhered on a rectangular soft thin-layer magnet strip 3 such as rubber magnet by a non-conductive adhesive and then fixed on a right leaf 1, an alarm circuit 4, and a plurality of card bags 5 adapted for inserting credit cards, life card or other cards and consecutively formed on a carrier cover 6 which is then overlain on the right leaf 1 to conceal the bags 5 between the leaf 1 and cover 6 and to reveal plural upper openings 54 for the cards C. The materials of leaves 1, 1', bag 5 and cover 6 are not limited and can be chosen from soft leathers for making wallet.

The alarm circuit 4 includes: a sounding integrated circuit 47 electrically and operatively connected to a power source 41, a first wire 42 electrically connected between a negative pole of the power source 41 and one strip 2 of the two longitudinal strips 2, 2', a second wire 43 connected between the other strip 2' and the sounding integrated circuit 47 and operatively connected to the negative of power source 41, a light-emitting diode (LED) 44 formed on the right leaf 1 and connected in parallel between the positive pole and the negative pole of the power source 41, a sensitive photoresistor 45 formed on leaf 1 aside the LED 44 having resistance range, e.g., from a light resistance of 10 kilo-ohms through a dark resistance of 100 kilo-ohms electrically connected between the negative pole and a trigger pin 471, operatively charged with positive voltage only, of integrated circuit 47 which can be chosen from UM 3161 of Taiwan Lien-Hua Co., an inert photoresistor 46 formed on the left leaf 1' corresponding to the LED 44, having a resistance range, e.g., from a light resistance of 20 kilo-ohms to a dark resistance of 120 kilo-ohms electrically connected between the positive pole of power source 41 and the trigger pin 471 of IC 47, and a buzzer 48 electrically connected to IC 47.

Each card bag 5 is formed with a lower small opening **50*a* near the lower edge of front layer 50 of the bag 5 facing the leaf 1, a metallic foil chip 53 is adhered on the front side of a rear layer 51 corresponding to the small opening 50*a* and operatively contacting the two longitudinal strips 2, 2' on leaf 1, a ferrous chip 52 adhered on the back side of the rear layer 51 corresponding to the metallic foil chip 53 and magnetically attracted to the soft thin-layer magnet strip 3 on leaf 1, and an upper opening 54 formed outwardly on the cover 6 adapted for the insertion of a card c. The materials of strip 2, 2' and foil chip 53** can be chosen from aluminum, copper or other electric conductive metals.

Figure 3:
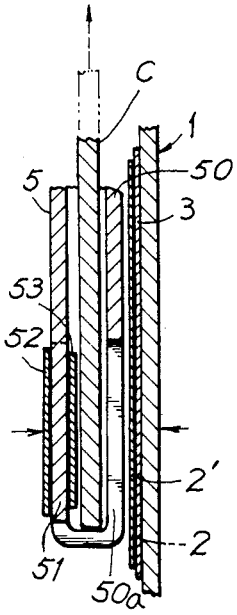
FIG. 3 is a partial sectional side-view drawing of the present invention.
Figure 4:
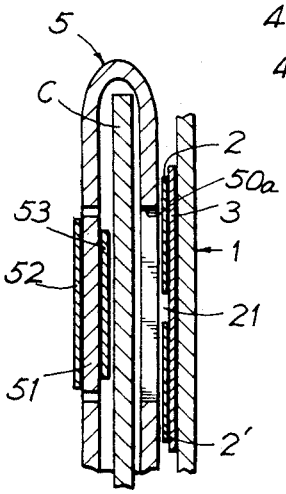
FIG. 4 is a partial sectional top view of the present invention.
Figure 5:
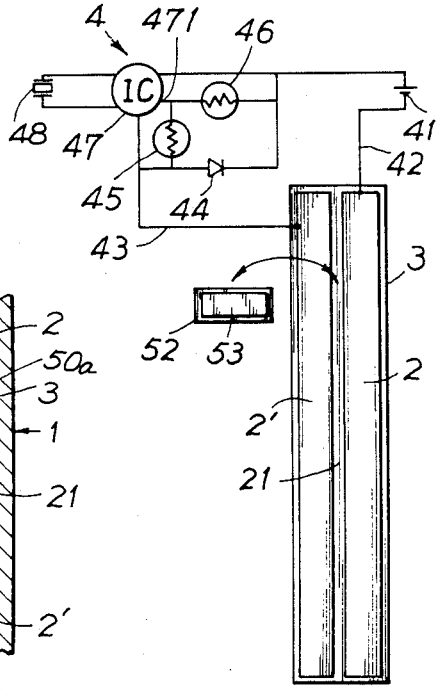
FIG. 5 shows an alarm circuit in accordance with the present invention.

When the two leaves 1, 1' are folded and if any card C is forgotten to reinsert into the bag 5 as shown in dotted line of FIG. 3, the ferrous chip 52 will be magnetically attracted toward the magnet strip 3 to allow the foil chip 53 electrically contacting with the longitudinal strip 2, 2' to close the alarm circuit 4 (to complete wire 42 with wire 43) to energize the light-emitting diode (LED) 44 to actuate the inert photoresistor 46 to reduce its resistance and increase its positive voltage so as to start the sounding IC 47 for sounding an alarm through buzzer 48 for reminding the wallet owner about his or her possible missing of a card. At the same time, the sensitive photoresistor 45 is not exposed under light from LED 44 when the leaves 1, 1' are closed and its dark resistance (e.g. 100 k-ohms) is higher than the resistance of the inert photoresistor 46 so that the positive voltage is exlusively charged into trigger pin 471 of IC 47.

When the two leaves 1, 1' are still opened to allow all the photoresistors 45, 46 being under environmental light exposure, the light resistance of sensitive photoresistor 45 (e.g. 10 K-ohm) is less than that of the inert photoresistor 46 (e.g. 20 k-ohms) to preclude the positive voltage through the photoresistor 46 charging into trigger pin 471 of IC 47 to thereby prevent any false alarm sounding.

The present invention is superior to the conventional credit card carrier with the following advantages:

1. The metallic foil chip 53 is operatively contacted with the longitudinal metallic strip 2, 2' by the magnetic attraction between the magnet strip 3 and the ferrous chip 52 without exerting elasticity fatigue failure as found in Mcneely's spring-biased chips, to thereby enhance its function and prolong the service life.

2. Each card C is inserted into and limited within each bag 5 to ease the smooth manipulation of the present invention and to stabilize the storage of cards C as well defined in the bags 5.

3. The chips and strips may be made thinner or made as foils to be suitable for making a soft wallet, comfortable and unlimited for portable or storage uses.

What is claimed is:

1. A wallet with missing-card reminder comprising:

a pair of leaves foldable upon each other having a pair of longitudinal conductive metallic strips spaced with an aperture therebetween parallelly adhered on a rectangular soft thin-layer magnet strip by a non-conductive adhesive and then fixed on a right leaf of the pair of leaves;

a pluralilty of card bags adapted for inserting credit cards, life card or other cards therein and consecutively fixed on a carrier cover which is overlain on said right leaf to define said bags between said cover and said right leaf, each card bag formed with a lower small opening on the lower edge of the front layer of the bag facing the two longitudinal metallic strips, a metallic foil chip adhered on the front side of a rear layer of the bag facing the lower small opening and operatively contacting said two metallic strips on the right leaf, a ferrous chip fixed on a rear side of the rear layer of the bag corresponding to said foil chip and magnetically attracted to said magnet strip on said right leaf, and an upper opening formed on the top edge of each bag adapted for inserting a card therein; and an alarm circuit including a sounding integrated circuit electrically and operatively connected to a power source, a first wire connected between the negative pole of said power source and one strip of the two longitudinal metallic strips on the right leaf, a second wire connected between the other strip and the sounding integrated circuit (IC) of said alarm circuit, a light-emitting diode (LED) formed on the right leaf and connected in parallel between a positive and a negative pole of the power source, a sensitive photoresistor formed on the right leaf aside from the LED and having a resistance range ranging from 10 kilo-ohms to 100 kilo-ohms from its light resistance to its dark resistance electrically connected between the negative pole of the power source and a trigger pin only charged by positive voltage of the sounding IC, an inert photoresistor formed on a left leaf of the two leaves corresponding to the LED adapted to be under light exposure of the LED when closing the two leaves having a resistance range from 20 kilo-ohms to 120 kilo-ohms and electrically connected between the positive pole and the trigger pin of said sounding IC, and a buzzer electrically actuated by the sounding IC, whereby upon the folding or closing of the two leaves and without reinserting a card into any card bag, the foil chip of said card bag is contacted with the longitudinal strips on the right leaf as magnetically attracted by the magnet strip and the ferrous chip to complete the alarm circuit and light the LED to increase the positive voltage through the inert photoresistor to thereby start the sounding IC for sounding an alarm for reminding the wallet owner about his or her possible missing of a card.

* * * * *